US006971436B2

(12) United States Patent
Huang

(10) Patent No.: US 6,971,436 B2
(45) Date of Patent: Dec. 6, 2005

(54) CONNECTING METHOD FOR WAX PATTERNS OF A GOLF CLUB HEAD

(75) Inventor: Chun-Yung Huang, Kaohsiung Hsien (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 28 days.

(21) Appl. No.: 10/819,950

(22) Filed: Apr. 8, 2004

(65) Prior Publication Data

US 2005/0224208 A1 Oct. 13, 2005

(51) Int. Cl.[7] ..... B22C 9/04
(52) U.S. Cl. ..... 164/35; 164/45; 164/516
(58) Field of Search ..... 164/34–36, 45, 164/516–519; 29/447

(56) References Cited

U.S. PATENT DOCUMENTS 4,190,093 A * 2/1980 Kearney et al. ..... 164/34

FOREIGN PATENT DOCUMENTS

TW 514574 A 12/2002

* cited by examiner

*Primary Examiner*—Kuang Y. Lin

(74) *Attorney, Agent, or Firm*—Birch, Stewart, Kolasch & Birch, LLP

(57) ABSTRACT

A connecting method for the wax patterns of the golf club head includes the steps of: prefabricating a first wax pattern and a second wax pattern, the first wax pattern providing with an engaging portion for engaging with the second wax pattern; employing a temperature difference to generate a manufacturing volume tolerance between the first wax pattern and the second wax pattern; combining the engaging portion of the first wax pattern with the second wax pattern; and cooling the first wax pattern to shrink the engaging portion so as to fittingly combine the first wax pattern with the second wax pattern.

5 Claims, 10 Drawing Sheets

CONNECTING METHOD FOR WAX PATTERNS OF A GOLF CLUB HEAD

BACKGROUND OF THE INVENTION

1. Field of the Invention

The present invention relates to a connecting method for wax patterns of a golf club head. More particularly, the present invention relates to the connecting method of employing volume's shrinkage of wax patterns for combining with each other that may simplify an assembling process for the wax patterns of the golf club head.

2. Description of the Related Art

Referring initially to FIGS. 1 through 3, Taiwanese Pat. Publication No. 514574 discloses a manufacturing method for a golf club head. The manufacturing method includes the steps of:

1. Separately prefabricating two wax patterns 10, 20, as shown in FIG. 1. Wax liquid is injected into a first mold assembly and a second mold assembly (not shown) to form two wax patterns 10, 20, such as a main-body wax pattern 10 and a striking-plate wax pattern 20.
2. Adhering the two wax patterns, as shown in FIG. 1. The two wax patterns 10, 20 are adhered to constitute a combination member.
3. Forming a ceramic shell 30 in slurry, as shown in FIG. 2. The combination pattern of the two wax patterns 10, 20 is immersed in slurry that forms a ceramic shell 30. After heating, the two wax patterns encompassed in the ceramic shell 30 are changed to the melting wax liquid for discharging it from the ceramic shell 30. The ceramic shell 30 forms an inward protrusion for correspondingly casting a rear recession of a golf club head, and a pouring gate at its side portion.
4. Investment casting an iron club head within the ceramic shell 30, as shown in FIG. 3. A melting alloy is poured into the ceramic shell 30 to fabricate the iron club head. After cooling, the iron club head casting 40 is formed within the ceramic shell 30 which can be broken to take out an integrated member of the iron club head casting 40.

According to the above-mentioned manufacturing method, the club head casting 40 forms a rear recession 41 at its rear side to constitute an undercut configuration that may enhance striking performance and satisfy the need of product quality. However, there are several drawbacks in manufacturing. For example, in adhering process the wax liquid is generally filled within a groove extending between the main-body wax pattern 10 and the striking-plate wax pattern 20. As best shown in FIGS. 1*a*, 2*a* and 3*a*, when the filling process is incomplete, there exists a gap (a) remained between the main-body wax pattern 10 and the striking-plate wax pattern 20. Thus, the slurry may invade into the gap (a) in the immersing process for forming the ceramic shell. Consequently, the interior of the ceramic shell 30 may consists of burrs (b) after lost-wax processing. In investment casting process, the club head casting 40 may form many cracks (c) between a main-body wax portion and a striking-plate wax portion due to the burrs (b). Furthermore, an excess of the wax liquid cause an overflow from the groove between the main-body wax pattern 10 and the striking-plate wax pattern 20. After hardening, although the harden wax may fill the groove formed between the main-body wax pattern 10 and the striking-plate wax pattern 20, an irregular surface (not shown) may remain on the groove of the combination member. Hence, there is a need for eliminating the irregular surface of the club head casting 40 by precision machining or polishing. This results in an additional process in manufacturing the golf club head. Especially, if the irregular surface is remained in the rear recession 41 of the club head casting 40, a machining tool is hard or inconvenient for inserting into the rear recession 41 of the club head casting 40 for processing. Certainly, it may result in difficulty of machining, and an increase of manufacturing cost and time.

The present invention intends to provide a connecting method for wax patterns a golf club head which delays cooling a first wax pattern in proper and cools a second wax pattern. A manufacturing volume tolerance is enlarged between the first and second wax patterns for conveniently combining each other in such a way to mitigate and overcome the above problem.

SUMMARY OF THE INVENTION

The primary objective of this invention is to provide a connecting method for wax patterns a golf club head which employs a temperature difference of the wax patterns to generate a manufacturing volume tolerance between the wax patterns. Thereby the wax patterns are able to fittingly combine each other that may increase the overall quality of the golf club head.

The connecting method for the wax patterns of the golf club head in accordance with the present invention includes the steps of: prefabricating a first wax pattern and a second wax pattern, the first wax pattern providing with an engaging portion for engaging with the second wax pattern; employing a temperature difference to generate a manufacturing volume tolerance between the first wax pattern and the second wax pattern; combining the engaging portion of the first wax pattern with the second wax pattern; and cooling the first wax pattern to shrink the engaging portion so as to fittingly combine the first wax pattern with the second wax pattern.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings wherein.

DETAILED DESCRIPTION OF THE INVENTION

Figure 1:
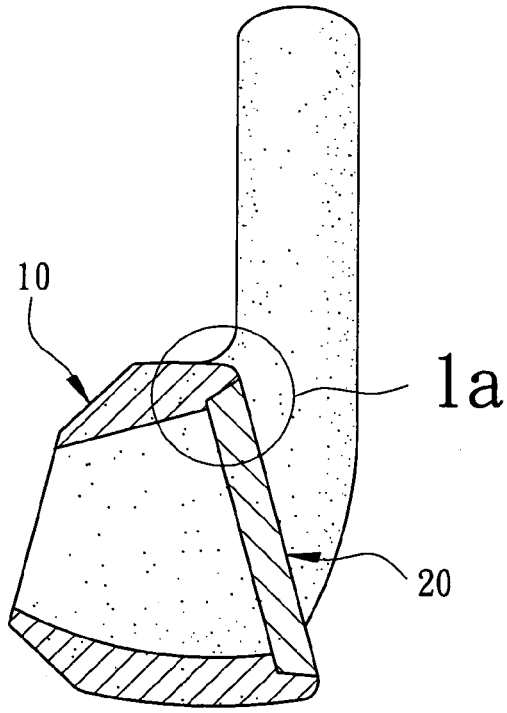
FIG. 1 PRIOR ART
FIG. 1 is a cross-sectional view of wax patterns of a conventional golf club head in accordance with the prior art.
Figure 1A:
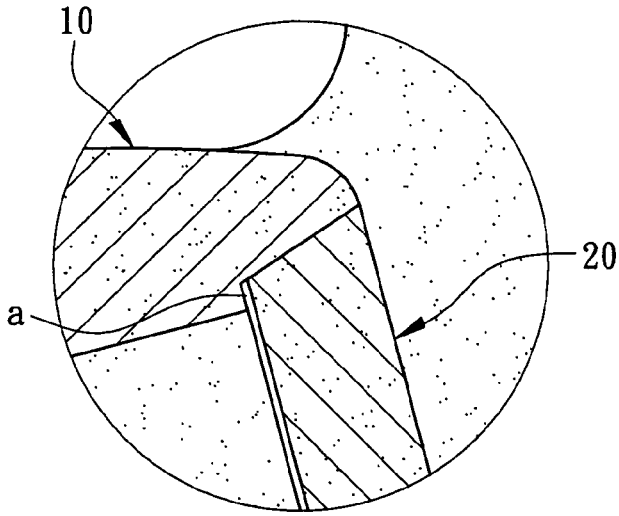
FIG. 1a PRIOR ART
FIG. 1*a* is an enlarged view, in FIG. 1, of the wax patterns of the golf club head in accordance with the prior art.
Figure 2:
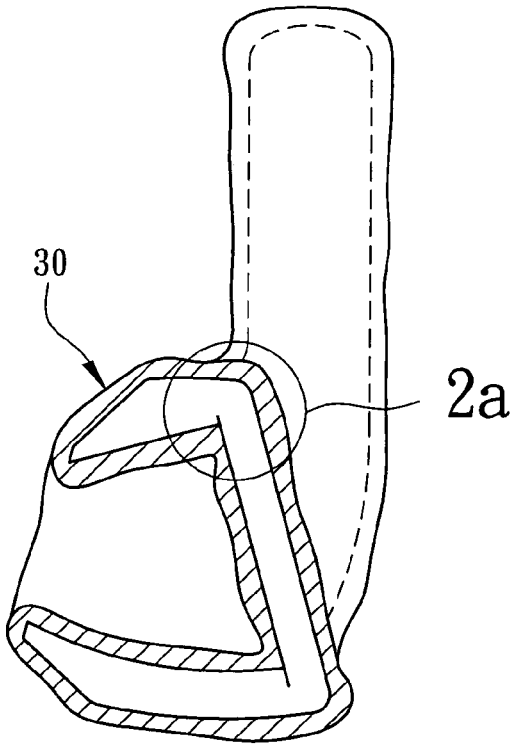
FIG. 2 PRIOR ART
FIG. 2 is a cross-sectional view of a ceramic shell of the golf club head in accordance with the prior art.
Figure 2A:
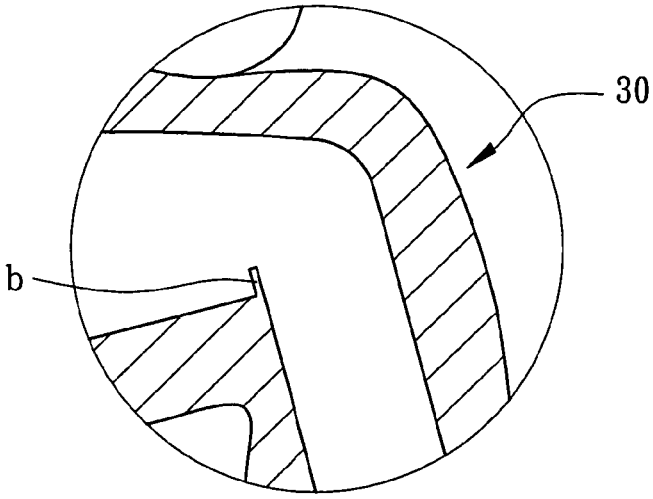
FIG. 2a PRIOR ART
FIG. 2*a* is an enlarged view, in FIG. 2, of the ceramic shell of the golf club head in accordance with the prior art.
Figure 3:
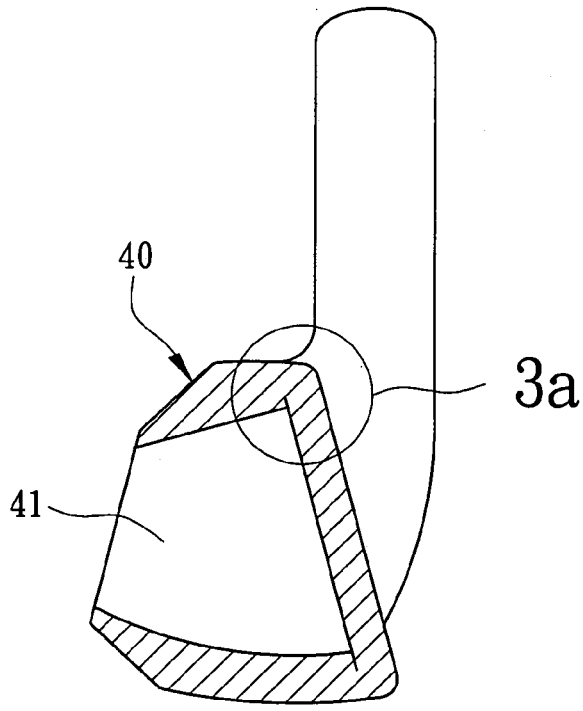
FIG. 3 PRIOR ART
FIG. 3 is a cross-sectional view of a club head casting in accordance with the prior art.

The reference numerals of the first and second embodiments of the present invention have applied the identical numerals of the conventional golf club head members, as shown in FIGS. 1 through 3. The construction of golf club head member members in accordance with embodiments of the present invention have similar configuration and same function as that of the conventional golf club head members and detailed descriptions may be omitted.

Figure 4:
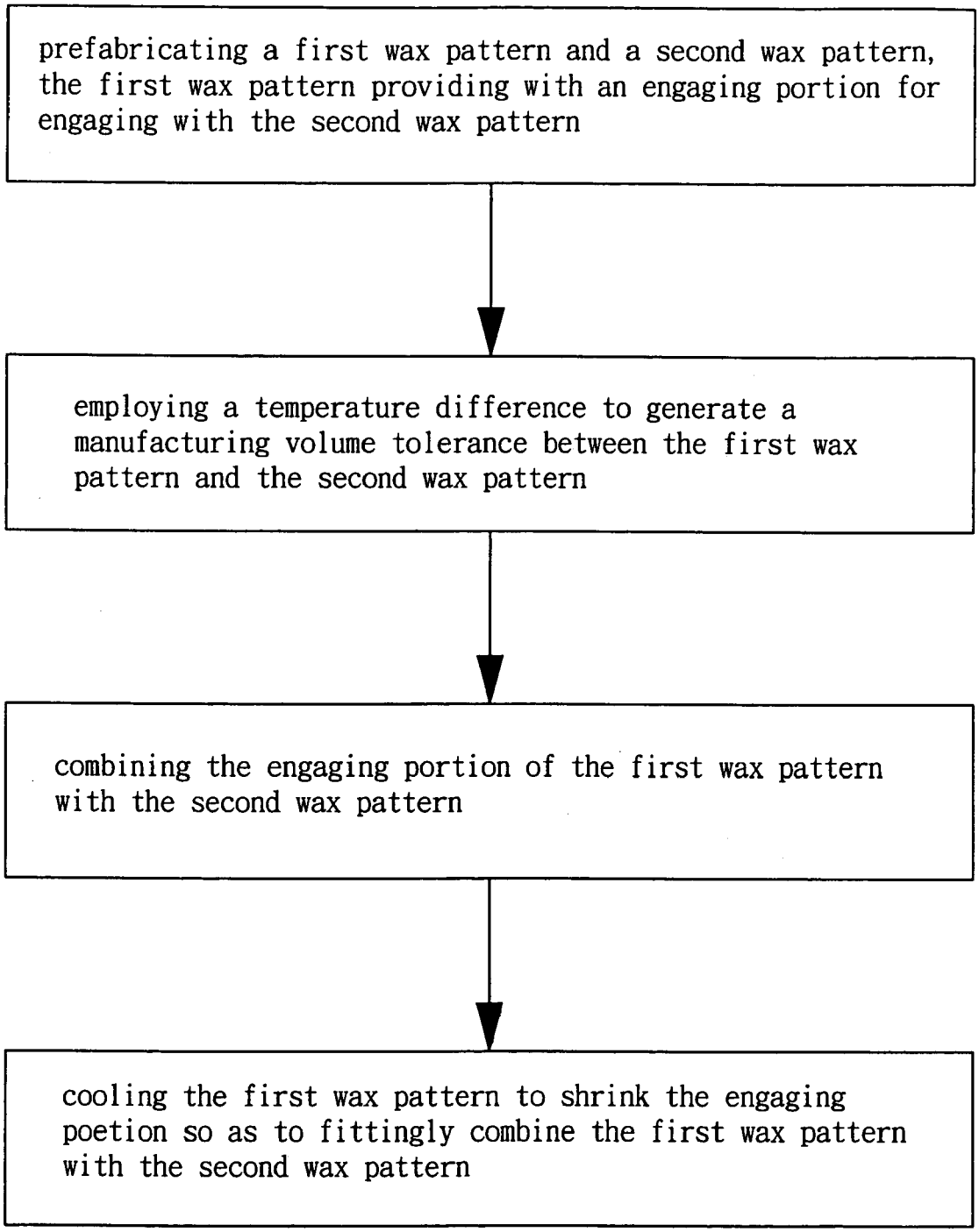
FIG. 4 is a block diagram of a connecting method for wax patterns a golf club head in accordance with the present invention.
Figure 5:
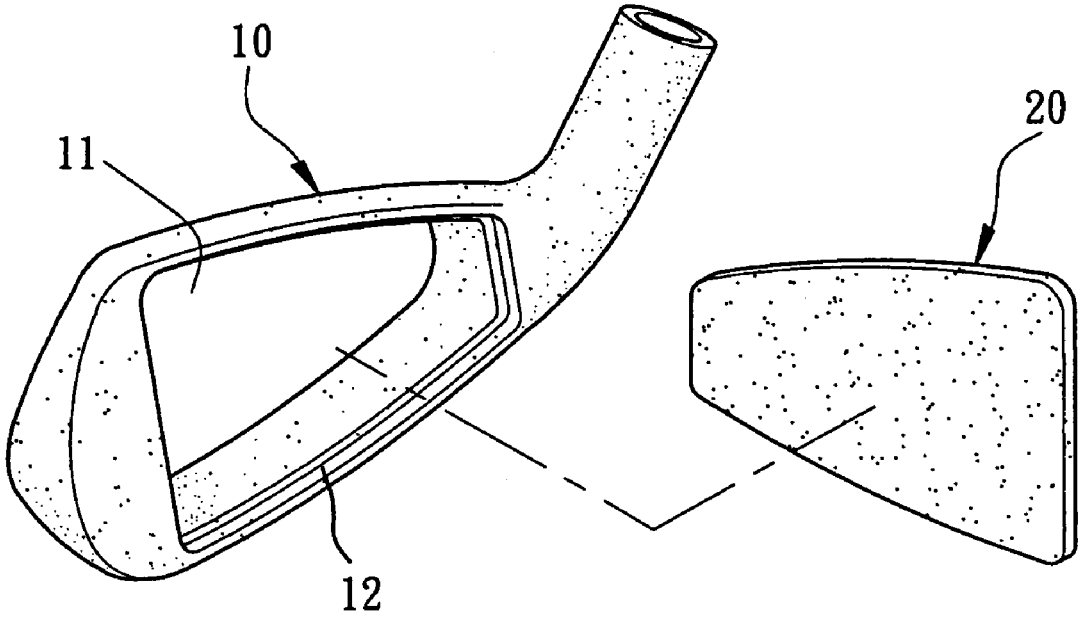
FIG. 5 is an exploded perspective view of wax patterns of the golf club head in a first step of a connecting method in accordance with the first embodiment of the present invention.

Referring to FIGS. 4 and 5, a first step of the connecting method for the wax patterns in accordance with a first embodiment of the present invention separately prefabricates a first wax pattern 10 and a second wax pattern 20. The construction of the first wax pattern 10 provides with a rear opening 11 and an engaging portion 12 connected thereto. First, wax liquid is injected into a mold assembly (not shown) for separately prefabricating the first wax pattern 10 and the second wax pattern 20. Preferably, the first wax pattern 10 and the second wax pattern 20 are club component patterns selected from a group consisting of a main-body wax pattern and a striking-plate wax pattern for example. In the illustrated embodiment the opening 11 of the main-body wax pattern 10 connects the rear side to the front side. Furthermore, the rear opening 11 of the first wax pattern 10 connects to the engaging portion 12 proximate the front side for engaging with the second wax pattern 20.

Figure 6A:
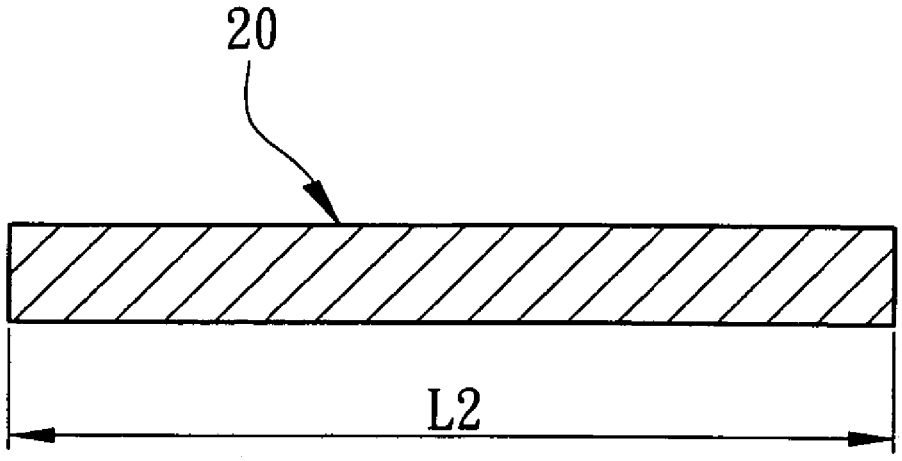
FIG. 6*a* is a cross-sectional view of the striking-plate wax pattern of the golf club head in a second step of the connecting method in accordance with the first embodiment of the present invention.
Figure 6B:
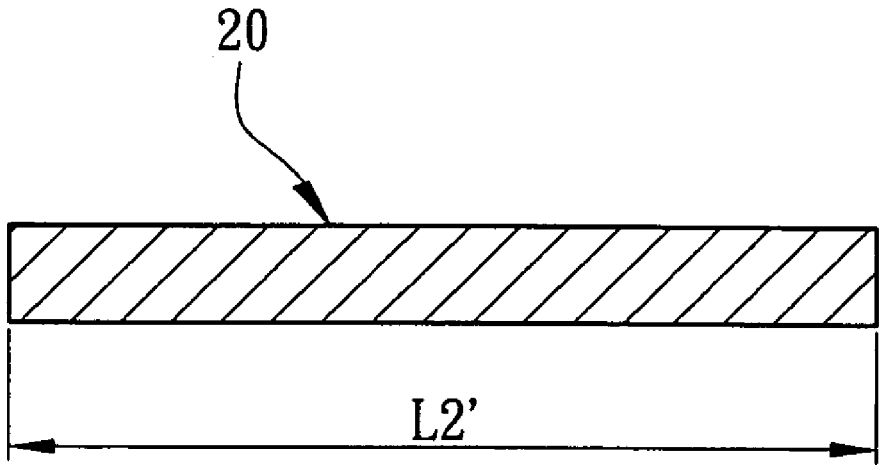
FIG. 6*b* is a cross-sectional view, similar to FIG. 6*a*, of the shrunk striking-plate wax pattern of the golf club head in a second step of the connecting method in accordance with the first embodiment of the present invention.

Turning now to FIGS. 4, 6 and 6*a*, a second step of the connecting method for the wax patterns in accordance with the first embodiment the present invention employs a temperature difference to generate a manufacturing volume tolerance between the first wax pattern 10 and the second wax pattern 20. The material of wax may expand when hot and shrink when cool, which has a shrinkage rate in length ranging between $^{8}/_{1000}$–$^{17}/_{1000}$. To accomplish such a manufacturing volume tolerance, the second wax pattern 20 is processed to cool in proper for shrinking volume thereof. After cooling down to a predetermined low temperature, a first outer diameter L2 of the second wax pattern 20 is reduced to a second outer diameter L2'. In order to maintain an inner diameter L1 of the engaging portion 12 of the first wax pattern 10 in a greater length, the first wax pattern 10 is thermal-insulated at a predetermined high temperature that is relatively higher than that of the second wax pattern 20. In the same temperature, the first outer diameter L2 of the second wax pattern 20 may be slightly greater than the inner diameter L1 of the engaging portion 12 of the first wax pattern 10 prior to cooling the second wax pattern 10. In different temperature, the second outer diameter L2' of the second wax pattern 20 may be specifically smaller than the inner diameter L1 of the engaging portion 12 of the first wax pattern 10 for loose-fitting. Because of this, the temperature difference permits a desired manufacturing volume tolerance between the first wax pattern 10 and the second wax pattern 20.

Figure 7A:
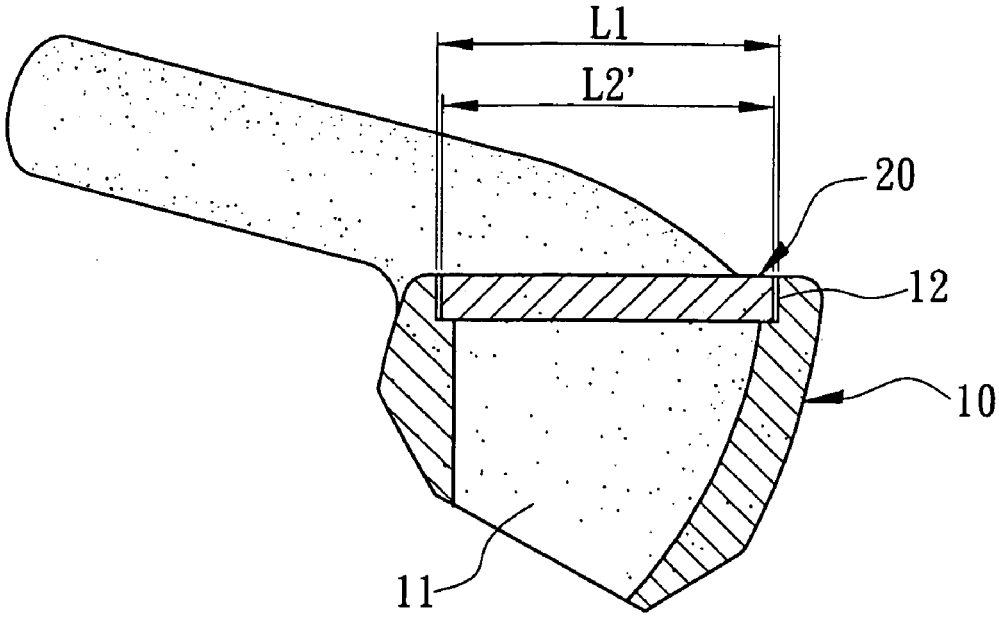
FIG. 7*a* is a cross-sectional view of the combined wax patterns of the golf club head in a third step of the connecting method in accordance with the first embodiment of the present invention.

Turning now to FIGS. 4 and 7*a*, a third step of the connecting method for the wax patterns in accordance with the first embodiment of the present invention initially combines the engaging portion 12 of the first wax pattern 10 with the second wax pattern 20. After cooling the second wax pattern 20, the second outer diameter L2' is able to insert into the inner diameter L1 of the engaging portion 12 in convenience by means of loose fitting. In assembling, the inner diameter L1 of the engaging portion 12 of the first wax pattern 10 may not interfere with the second outer diameter L2' of the second wax pattern 20 such that a connection boundary between the first and the second wax patterns may not be destroyed. Consequently, it ensures the constructions of the first wax pattern 10 and the second wax pattern 20 in good condition.

Figure 7B:
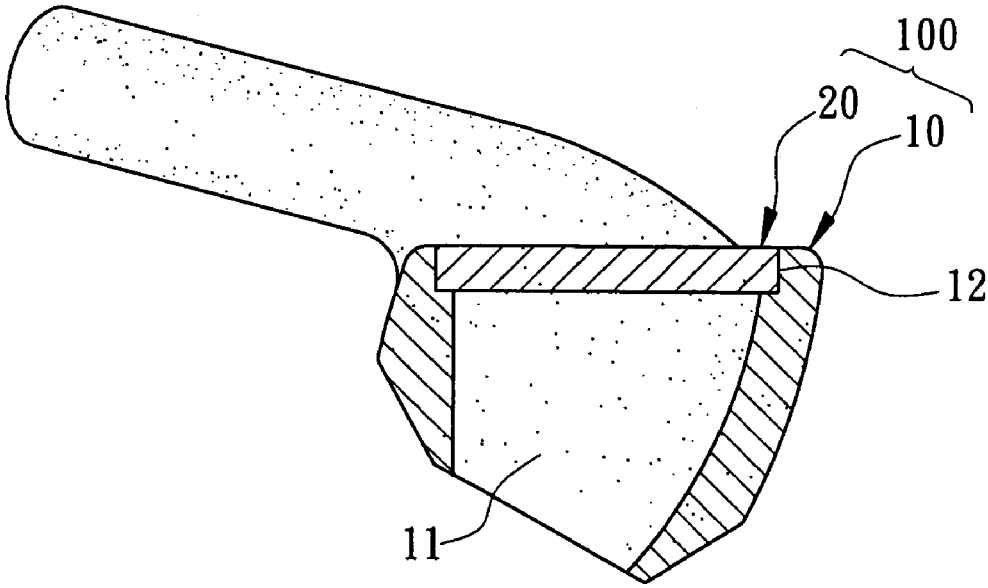
FIG. 7*b* is a cross-sectional view of the combined wax patterns of the golf club head in a fourth step of the connecting method in accordance with the first embodiment of the present invention.

Turning now to FIGS. 4 and 7*b*, a fourth step of the connecting method for the wax patterns in accordance with the first embodiment of the present invention cools the first wax pattern 10 to shrink the engaging portion 12. Thereby the engaging portion 12 fittingly combines the first wax pattern 10 with the second wax pattern 20 to form a wax club head 100. To this end, the engaging portion 12 of the first wax pattern 10 may be gradually shrunk to engage with an outer circumference of the second wax pattern 20 when the temperature is successively decreased. Finally, since the second outer diameter L2' is substantially equal to or slightly greater than the reduced inner diameter of the engaging portion 12, an inner circumference of the engaging portion 12 fittingly combines with the outer circumference of the second wax pattern 20. Consequently, there is no gap remained between the inner circumference of the engaging portion 12 and the outer circumference of the second wax pattern 20 that may increase the overall quality of the golf club head.

Figure 8:
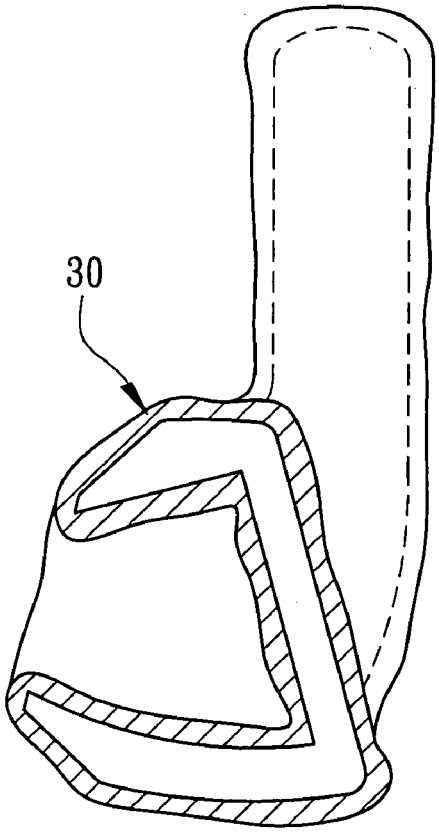
FIG. 8 is a cross-sectional view of a ceramic shell of the golf club head in accordance with the first embodiment of the present invention.
Figure 9:
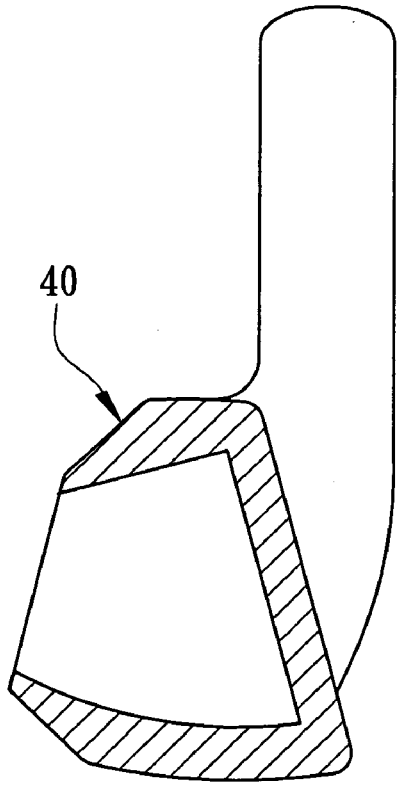
FIG. 9 is a cross-sectional view of a club head casting in accordance with the first embodiment of the present invention.

Turning now to FIGS. 8 and 9, subsequently, the wax club head 100 is immersed in slurry to form a ceramic shell 30 and heats the ceramic shell 30 for lost-wax processing. Next, a melting alloy is poured into the ceramic shell 30 to fabricate a club head casting 40. Finally, the club head casting 40 can be taken out by breaking the ceramic shell 30.

In the illustrated embodiment the wax club head 100 can omit a filling process of wax liquid that avoids an overflow due to an excess of the wax liquid or incomplete filling which causes an irregular surface. This results in the wax club head 100 forming a smooth surface instead of an irregular surface. Consequently, the club head casting 40 has a smooth surface that may increase the overall quality of the golf club head. Also, the smooth surface of the club head casting 40 results in a decrease in the need of precision machining that may simplify the machining process and reduce manufacturing cost.

Figure 10:
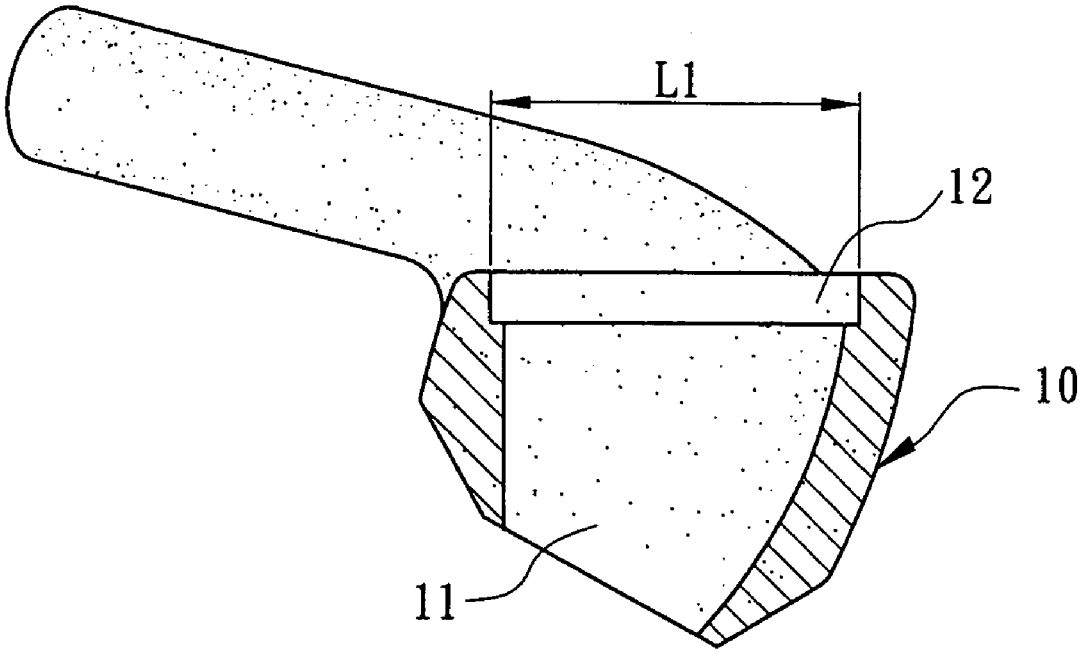
FIG. 10 is a cross-sectional view of a main-body wax pattern of the golf club head in a second step of the connecting method in accordance with a second embodiment of the present invention.
Figure 11A:
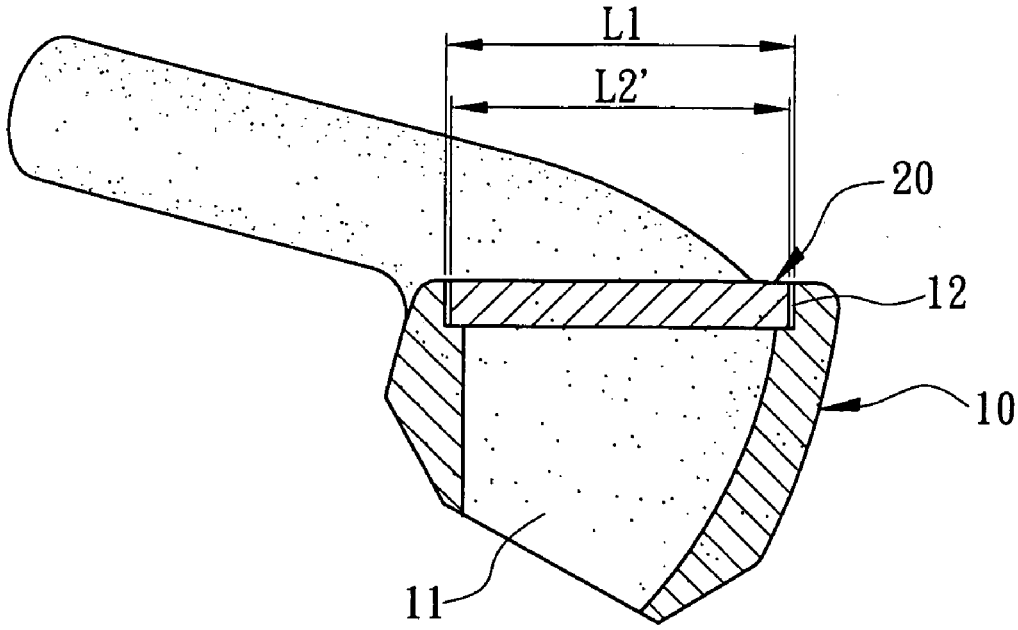
FIG. 11*a* is a cross-sectional view of the combined wax patterns of the golf club head in a third step of the connecting method in accordance with the second embodiment of the present invention.
Figure 11B:
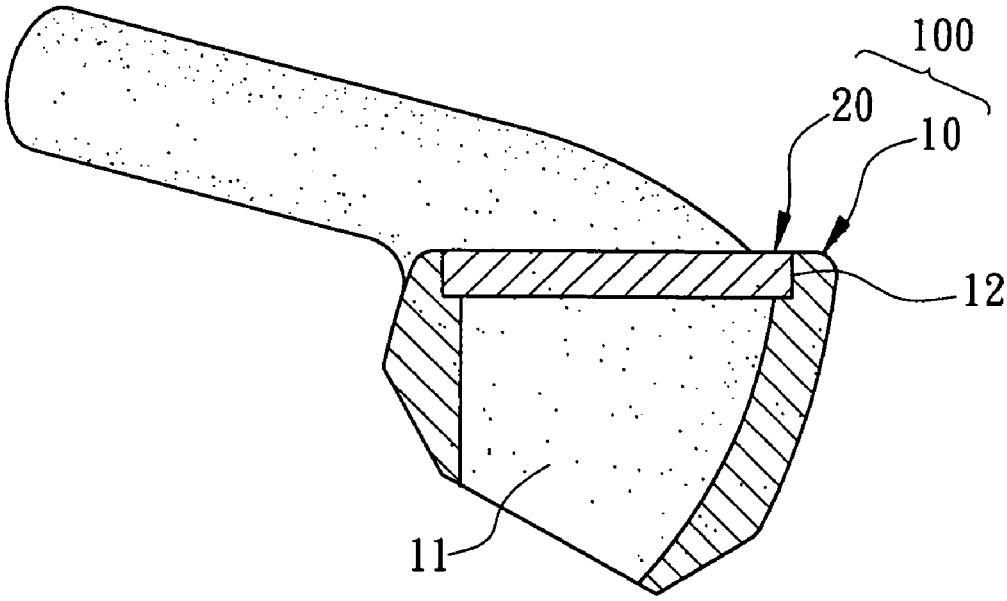
FIG. 11*b* is a cross-sectional view of the combined wax patterns of the golf club head in a fourth step of the connecting method in accordance with the second embodiment of the present invention.

Turning now to FIGS. 10, 11*a* and 11*b*, the connecting method for the wax patterns in accordance with a second embodiment of the present invention, in comparison with the first embodiment, employs a heater (not shown) heating the first wax pattern 10 to maintain it at a predetermined high temperature. Once the predetermined low temperature of the second wax pattern 20 is relatively lower than that of the first wax pattern 10, a desired manufacturing volume tolerance between the first wax pattern 10 and the second wax pattern 20 is obtained. However, for strength and rigidity, the heating temperature of the first wax pattern 10 is considerably lower than a melting point so that the construction of the first wax pattern 10 is relatively rigid and strong to withstand normal usage in manufacture. In this circumstance, the inner diameter L1 of the engaging portion 12 is remained in a greater length. As best shown in FIG. 11*a*, after successively heating the first wax pattern 10, the inner diameter L1 of the engaging portion 12 of the first wax pattern 10 may be specifically greater than the outer diameter L2' of the second wax pattern 20 for loose-fitting. As best shown in FIG. 11*b*, the inner diameter L1 of the engaging portion 12 of the first wax pattern 10 may be gradually shrunk to engage with the outer circumference L2' of the second wax pattern 20 when the temperature is successively decreased. Finally, since the second outer diameter L2' is slightly greater than the reduced inner diameter of the engaging portion 12, an inner circumference of the engaging portion 12 fittingly combines with the outer circumference of the second wax pattern 20 to form a wax club head 100. Consequently, there is no gap remained between the inner circumference of the engaging portion 12 and the outer circumference of the second wax pattern 20 that may increase the overall quality of the golf club head. Referring back to FIGS. 8 and 9, the wax club head 100 is used to fabricate the ceramic shell 30 and the club head casting 40.

Figure 3A:
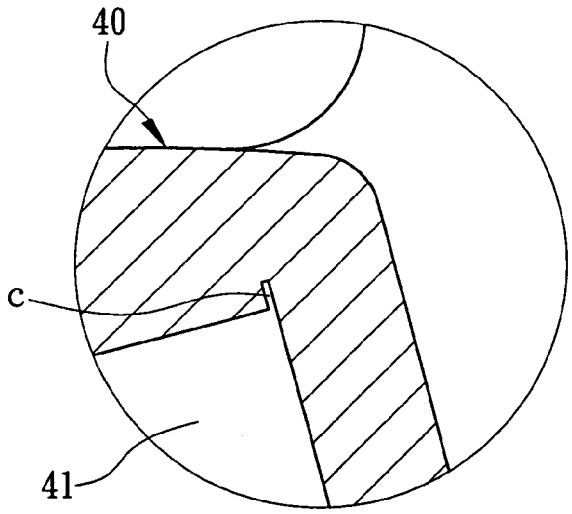
FIG. 3a PRIOR ART
FIG. 3*a* is an enlarged view, in FIG. 3, of the club head casting in accordance with the prior art.

Referring back to FIGS. 3 and 3*a*, the conventional club head casting 40 has many cracks (c) due to the gap (a) formed between the main-body wax pattern 10 and the striking-plate wax pattern 20. Referring back to FIG. 4, the first wax pattern 10 is thermal-insulated or heated at a predetermined high temperature to obtain a desired manufacturing volume tolerance between the first wax pattern 10 and the second wax pattern 20. Consequently, it may increase the overall quality of the golf club head.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A connecting method for wax patterns of a golf club head, comprising the steps of:

prefabricating a first wax pattern and a second wax pattern, the first wax pattern providing with an engaging portion;

employing a temperature difference to generate a manufacturing volume difference between the first wax pattern and the second wax pattern;

bringing together the engaging portion of the first wax pattern with the second wax pattern; and cooling the first wax pattern to shrink the engaging portion so as to fittingly combine the first wax pattern with the second wax pattern.

2. The connecting method for the wax patterns of the golf club head as defined in claim 1, wherein the first wax pattern forms with a main-body wax pattern while the second wax pattern forming with a striking-plate wax pattern.

3. The connecting method for the wax patterns of the golf club head as defined in claim 1, wherein the second wax pattern has an outer diameter substantially equal to or slightly greater than an inner diameter of the engaging portion of the first wax pattern.

4. The connecting method for wax patterns of a golf club head as defined in claim 1, wherein the second wax pattern is processed to cool for shrinking volume thereof.

5. The connecting method for wax patterns of a golf club head as defined in claim 1, wherein the first wax pattern is heated by a heater such that an inner diameter of the engaging portion of the first wax pattern is greater than an outer diameter of the second wax pattern.

* * * * *